US005182426A

United States Patent [19]

Sklenak et al.

[11] Patent Number: 5,182,426

[45] Date of Patent: Jan. 26, 1993

[54] MICROWAVE OVEN HAVING AN IMPROVED ANTENNA

[75] Inventors: John B. Sklenak, Sudbury; Joseph C. Maiellano, Jr., Chelmsford, both of Mass.

[73] Assignee: Raytheon Company, Lexington, Mass.

[21] Appl. No.: 809,459

[22] Filed: Dec. 17, 1991

[51] Int. Cl.[5] ..... H05R 6/72

[52] U.S. Cl. ..... 219/10.55 F

[58] Field of Search ..... 219/10.55 F, 10.55 A, 219/10.55 R

[56] References Cited

U.S. PATENT DOCUMENTS

| | | | |
|---|---|---|---|
| 2,761,942 | 9/1956 | Hall | 219/10.55 F |
| 3,366,769 | 1/1968 | Lima | 219/10.55 F |
| 4,629,849 | 12/1986 | Mizutani et al. | 219/10.55 F |
| 4,896,005 | 1/1990 | Skubich | 219/10.55 A |

FOREIGN PATENT DOCUMENTS

| | | | |
|---|---|---|---|
| 223956 | 8/1968 | U.S.S.R. | 219/10.55 F |

*Primary Examiner*—Philip H. Leung

*Attorney, Agent, or Firm*—Judith A. Caplan; Richard M. Sharkansky

[57] ABSTRACT

A microwave oven antenna having a three-dimensional motion. A vertical shaft has a microwave antenna coupled to a first end and is attached at a second end to a first driven gear. A cam follower member extends from the first driven gear to engage with a second driven gear having a slanted surface. The first and second driven gears are coupled to first and second drive gears by respective drive belts, such arrangement providing independent rotation to the first and second driven gears. Either the first and second drive gears or the first and second driven gears are of different diameter so that the relative motion of the gears provides the antenna in a different rotational position after consecutive vertical excursions. With this arrangement, the uniformity of heating food products in a microwave oven is improved by increasing the randomness of the mode pattern.

10 Claims, 8 Drawing Sheets

MICROWAVE OVEN HAVING AN IMPROVED ANTENNA

BACKGROUND OF THE INVENTION

This invention relates generally to microwave ovens and more particularly to a microwave oven antenna providing improved cooking uniformity.

As is known in the art, microwave ovens provide an effective way of cooking foods faster than can be achieved with conventional ovens. Microwave ovens include a magnetron for providing microwave radiation or energy and a feed arrangement to couple the radiation to a cooking cavity. In one type of feed arrangement, microwave energy is fed down a waveguide to a coaxial probe which is connected to an antenna in the cooking cavity.

As is also known in the art, a common problem associated with microwave ovens is uneven cooking. More particularly, undesirable hot and cold spots may occur in microwave cooked foods. This uneven cooking is due to, inter alia, a non-uniform distribution or pattern of the microwave energy within the cooking cavity.

One method known in the art for improving the uniformity of microwave cooking is to use a directive antenna. Such an antenna is designed to direct the microwave energy to form a desired pattern. However, the load (i.e. the food product) also impacts the microwave radiation pattern. Thus, unless only one type of food product is to be cooked in the microwave oven, the use of a directive antenna may not provide consistent cooking uniformity.

Another method for improving the uniformity of microwave cooking is to randomize the microwave pattern within the cooking cavity with a mode stirrer device, such as a rotating paddle. Although providing some improvement, mode stirrers have only been marginally effective. Another approach has been to rotate the food product within the cooking cavity, for example with a turntable device. In this way, what would otherwise be cold spots in the food are continuously moved to expose such portions to the microwave energy. Alternatively, the randomness of the radiation pattern can be increased by rotating the microwave antenna.

SUMMARY OF THE INVENTION

With the foregoing background in mind, it is an object of the present invention to provide a microwave oven having an antenna providing improved cooking uniformity.

It is a further object to provide such cooking uniformity by increasing the randomness of the microwave radiation pattern.

These and other objects are attained generally by providing a microwave oven comprising a cooking cavity, an antenna positioned within the cooking cavity, means for exciting the antenna with microwave energy, and means for rotating the antenna and simultaneously cycling the antenna through a vertical excursion. With this arrangement, the microwave energy pattern within the cooking cavity is randomized. Moreover, the random pattern improves the cooking uniformity of the microwave oven.

In accordance with a further aspect of the invention, the antenna is provided in a different rotational position after consecutive vertical excursions. With this arrangement, the randomness of the microwave energy pattern is enhanced.

BRIEF DESCRIPTION OF THE DRAWINGS

The foregoing will be better understood from a reading of the description of the preferred embodiment with reference to the drawings, wherein.

DESCRIPTION OF THE PREFERRED EMBODIMENTS

Figure 1:
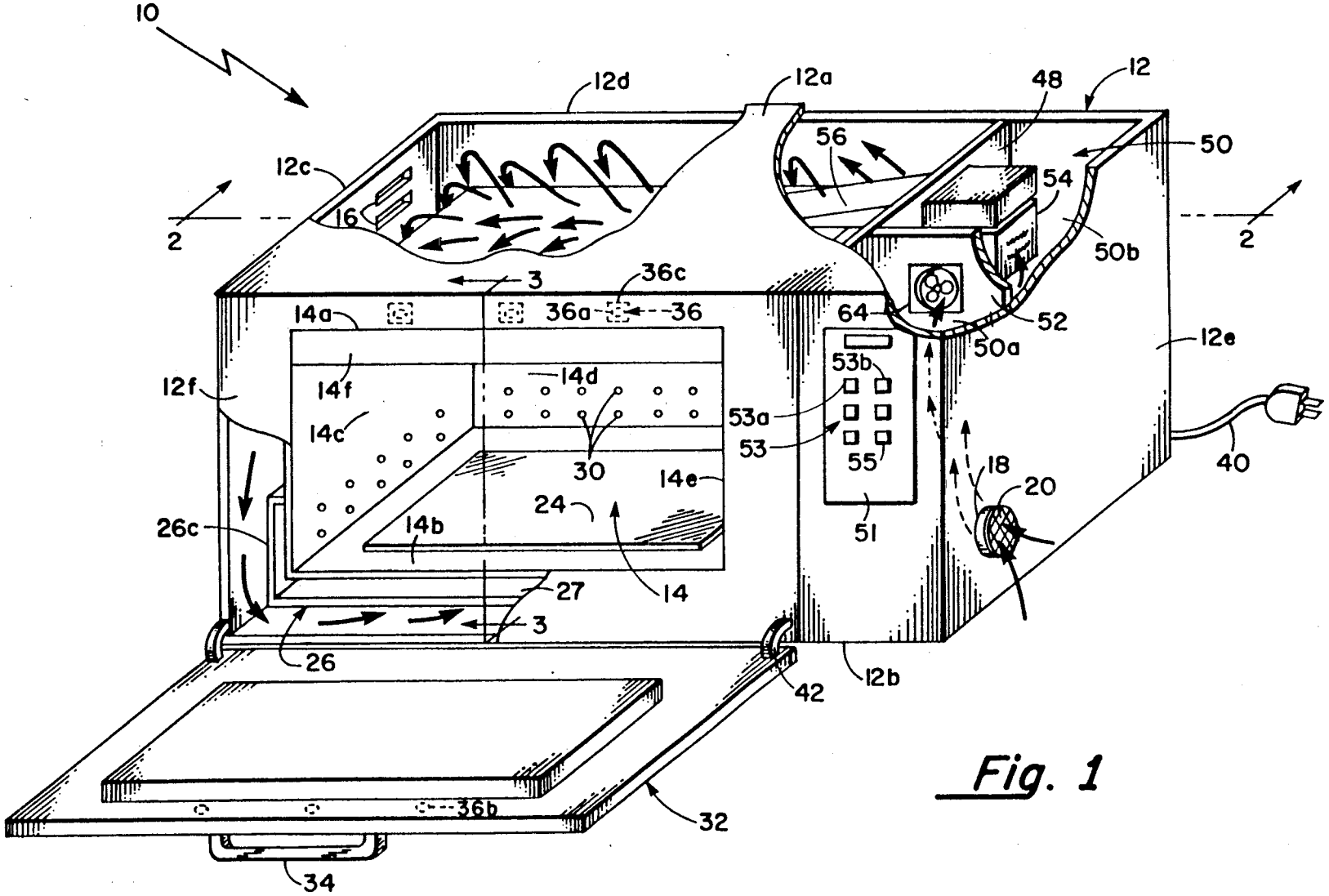
FIG. 1 is a partially broken away, somewhat simplified perspective view of a microwave oven.
Figure 2:
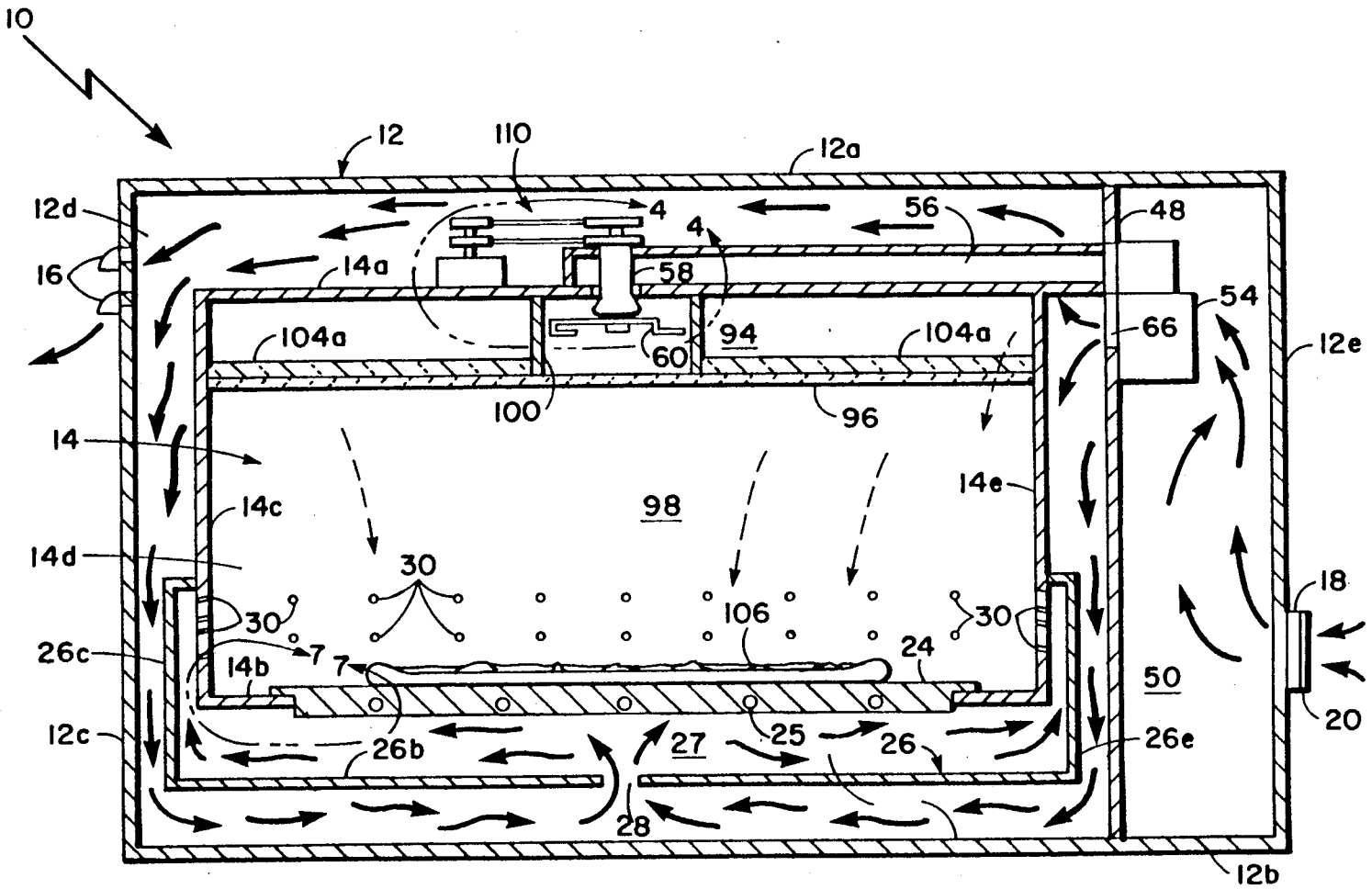
FIG. 2 is a partially sectioned plan view of the microwave oven taken along lines 2—2 of FIG. 1.
Figure 3:
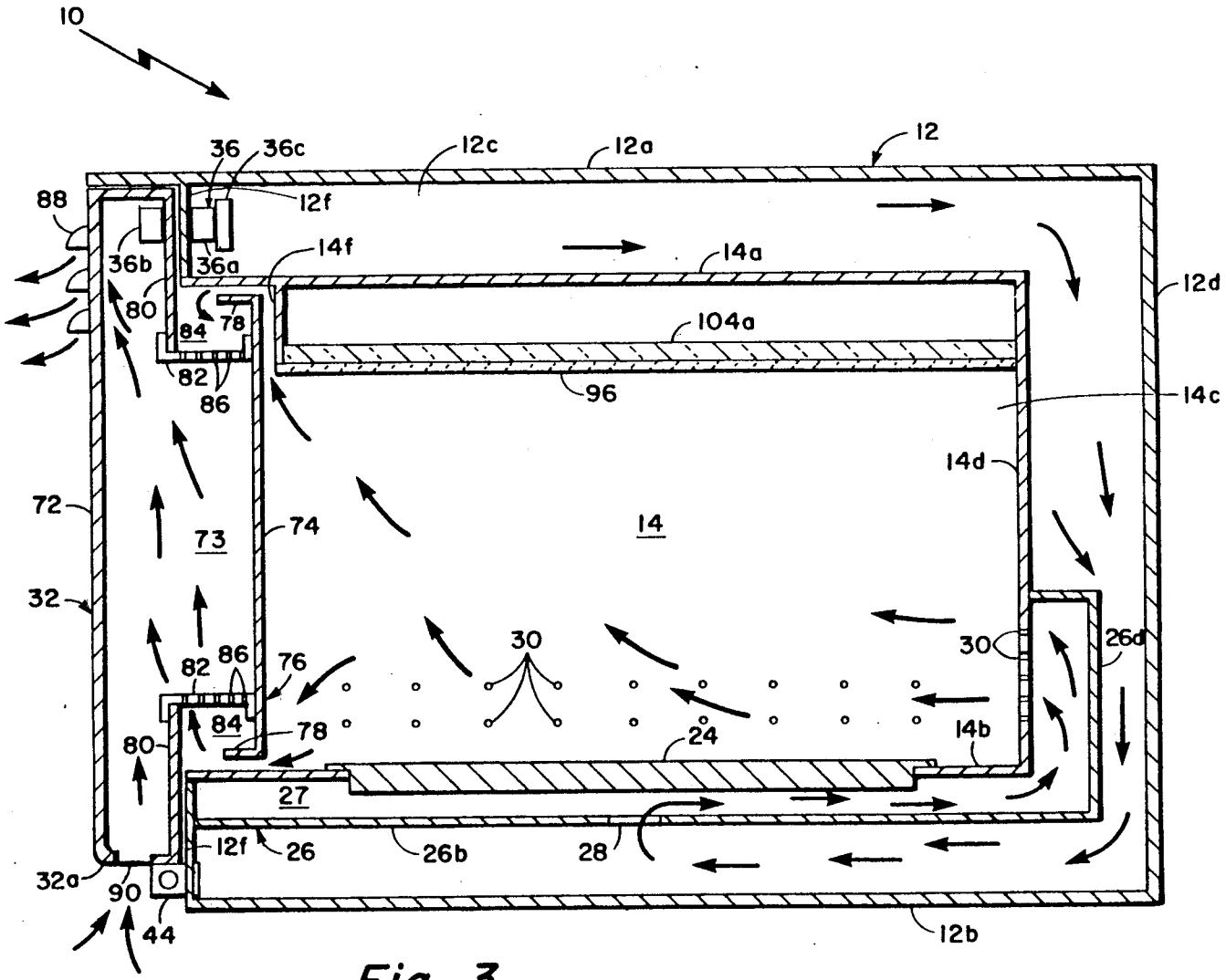
FIG. 3 is also a partially sectioned plan view of the microwave oven taken lines 3—3 of FIG. 1.

Referring now to FIGS. 1–3, a microwave oven 10 is shown to include an outer housing 12 having a cooking cavity 14 disposed therein. Outer housing 12 is here made of stainless steel, but alternatively may be made of any material having suitable strength and rigidity. Outer housing 12 has a top wall 12*a*, a bottom wall 12*b*, side walls 12*c* and 12*e*, a rear wall 12*d*, and a partial front wall 12*f*. Similarly, cooking cavity 14 is defined by a top wall or ceiling 14*a*, a bottom wall or floor 14*b*, side walls 14*c* and 14*e*, a rear wall 14*d*, and a partial front wall 14*f*. Cooking cavity 14 is here comprised of stainless steel, but may alternatively be comprised of any suitably strong and rigid conductive material. Here, the width of cooking cavity 14 substantially exceeds its height to provide a relatively low profile oven 10. More particularly, the width of cooking cavity 14 is approximately 18.0 inches while the height is approximately 3.8 inches. Cooking cavity 14 is coupled to outer housing 12 by any suitable means, such as a bracket (not shown) disposed between the bottom wall 14*b* of cooking cavity 14 and the bottom wall 12*b* of outer housing 12. Side wall 12*c* of outer housing 12 has a plurality of exhaust ports 16 disposed therethrough, as shown. An inlet port 18 is disposed through outer housing side wall 12*e* and has an inlet filter 20 disposed thereover, as is conventional.

An electric griddle 24, often referred to as a grill or hot plate, is disposed over a central portion of cooking cavity bottom wall 14*b*, as shown. Here, the electric griddle 24 is comprised of aluminum and has a Calrod heating element 25 (FIG. 2) coupled thereto, as will be described below. However, a griddle comprised of cast iron, or other suitable material may alternatively be used. Heating element 25 may alternatively be comprised of a plurality of individual heating elements. A griddle seal arrangement 22 couples the aluminum griddle 24 to the stainless steel cooking cavity bottom wall or floor 14*b* and will be described in conjunction with FIGS. 7A–7C which show alternate expanded views of circle 7—7 of FIG. 2.

Disposed between cooking cavity bottom wall 14b and bottom housing wall 12b is a wrapper 26 spacedly disposed around the cooking cavity bottom wall 14b and a lower portion of cooking cavity side walls 14c and 14e and rear wall 14d. Wrapper 26 has an aperture 28, here disposed through a bottom wall 26b thereof. Wrapper 26 further has a rear wall portion 26d (FIG. 3) disposed between outer housing rear wall 12d and cooking cavity rear wall 14d. Side wall portions 26c and 26e (FIG. 2) of wrapper 26 are disposed between outer housing side walls 12c and 12e and cooking cavity side walls 14c and 14e, respectively.

The air flow path through the aperture 28 in wrapper 26 provides convection cooking to food products, such as pizza 106 (FIG. 2), disposed within the cooking cavity 14, as will be described. Suffice it here to say, that wrapper 26 forms a sealed plenum 27 surrounding the cooking cavity bottom wall 14b and a lower portion of cooking cavity side walls 14c, 14e and rear wall 14d. Moreover, the cooking cavity side walls 14c, 14e and rear wall 14d have perforations 30 communicating from the plenum 27 to the cooking cavity 14.

A door 32 is coupled to outer housing 12 as shown in FIGS. 1 and 3, so that, in a closed position (FIG. 3), door 32 is adjacent to partial front wall 12f of outer housing 12 and partial front wall 14f of cooking cavity 14. Further, when door 32 is closed by pulling up on door handle 34 it is latched by a plurality of interlock mechanisms 36, and here three such mechanisms 36. Here, each interlock mechanism 36 comprises a first magnet 36a disposed behind partial front wall 12f of outer housing 12, a second magnet 36b disposed inside door 32, and a microswitch 36c disposed adjacent to the first magnet 36a (shown schematically in FIGS. 1 and 3). With this arrangement, when door 32 is in the closed position, magnets 36a and 36b attract each other to hold door 32 in the closed position. Furthermore, when the door 32 is closed, magnet 36a contacts microswitch 36c thereby activating such microswitch 36c. When activated, microswitch 36c allows power to be delivered to electronics within microwave oven 10. More particularly, here a power cord 40 (FIG. 1) is adapted for coupling a 220 Volt Alternating Current power source (not shown) to oven 10. When door 32 is in an open position, as shown in FIG. 1, microswitch 36c is deactivated thereby de-coupling such power source from the oven 10, as is conventional.

Door 32 may be coupled to partial front wall 12f of outer housing 12 by any hinge arrangement. For example, FIG. 1 shows a pair of door stops 42 which limit the downward excursion of door 32 and which may be used in conjunction with door hinge 44 (FIG. 3).

Referring specifically to FIGS. 1 and 2, a separating wall 48 is disposed within the outer housing 12 to separate a first portion of the housing 12, in which the cooking cavity 14 is disposed, from a second portion thereof, referred to hereinafter to as an electronics compartment 50. A control panel 51 (FIG. 1) is disposed on partial front wall 12f of outer housing 12. Conventional microwave oven control electronics (not shown), including inter alia a timer and a time of day clock, are disposed substantially behind control panel 51 and are activated by a plurality of controls 53, as is conventional.

Here, the controls 53 are selected as a function of the food size and type. For example, a first control 53a may be selected for cooking a large pizza having no toppings, whereas a second control 53b may be selected for cooking a small pizza with two toppings. Activation of each of such controls 53a and 53b corresponds to a cooking sequence, here comprising up to four time periods pre-programmed for a desired cooking power level and duration. More particularly, microwave oven 10 can operate at a high power level, a medium power level, or a low power level corresponding to a defrost operation, as is conventional. Thus, activating the control 53b when cooking a small pizza with two toppings may, for example, correspond to a cooking sequence comprising a first time period of 2.5 minutes of cooking at the high power level, followed by a second time period of one minute of cooking at the medium power level, followed by a third time period of 1.5 minutes of cooking at the low power level, and finally followed by a fourth time period of one minute of cooking at the medium power level. In this way, selection of a particular control 53 will provide a cooking sequence optimized for the particular food product being cooked. It should be appreciated however that other control arrangements may alternatively be used. In other words, it may be desirable to alternatively, or additionally, provide controls which are selected as a function of the desired time and/or power level for microwave cooking, as is conventional.

A partition 52 divides the electronics compartment 50 into a front portion 50a and a rear portion 50b (FIG. 1). The electronics mentioned above and disposed substantially behind control panel 51 are disposed in the front portion 50a of electronics compartment 50, whereas a conventional AC to DC converter and a magnetron 54 are disposed in the rear portion 50b of electronics compartment 50. A fan 64 is mounted to the partition 52, as shown.

Magnetron 54 is coupled to a microwave feed arrangement, here comprising a waveguide 56, a coaxial probe 58, and an antenna 60 (FIG. 2). With this arrangement, the cooking cavity 14 is energized with microwave energy or radiation, as will be described further below. More particularly, waveguide 56 here has a first end disposed above magnetron 54 and a second end extending to a central portion of cooking cavity top wall 14a, as shown in FIG. 2. As is conventional, coaxial probe 58 is designed to provide an impedance match between the magnetron 54 and the cooking cavity 14 in order to minimize reflections of the microwave energy.

A power switch 55 (FIG. 1) is also disposed on control panel 51, as shown. The power switch 55 is activated prior to activation of a selected one of the controls 53 in order to pre-heat the oven 10. More particularly, when the power switch 55 is activated, power is delivered to the Calrod heating element 25 of electric griddle 24 and to the fan 64. Here, when activated, griddle 24 is heated to a temperature of between an approximately 300° F. and 500° F. and, more preferably between approximately 400° F. and 450° F. Convective air flows in the oven 10 upon activation of power switch 55 due to activation of the fan 64, as will become apparent from the discussion below.

Note that it may be desirable to have a control mechanism which monitors the electric griddle 24 and convective air temperatures and compensates therefore by adjusting the microwave cooking time or power level in the event that the oven 10 was not suitably pre-heated. For example, consider the case where the operator of oven 10 activates power switch 55 and seconds later, selects control 53b after placing a small pizza into cooking cavity 14. In this case, the griddle 24 and the convective air will not be suitably pre-heated. Thus, it may be desirable to activate auxilliary heating elements which may be provided in the path of the convective air flow, for example.

Referring still to FIGS. 1-3, the flow or air through microwave oven 10 during the operation thereof will now be described. Note that the following discussion refers to operation of oven 10 in which microwave energy, convective air, and griddle 24 are used in combination to cook a food product 106 disposed in cooking cavity 14. It should be appreciated that microwave oven 10 can be adapted for cooking by microwave energy, griddle 24, or convective heating alone or in any combination. However, as will become apparent from the following discussion, if convection heating is used without activating the griddle 24, auxilliary heating elements must be provided.

When a food product 106 is placed in cooking cavity 14 and the appropriate one of the plurality of controls 53 on control panel 51 activated, magnetron 54 is activated thereby coupling microwave energy to microwave oven cooking cavity 14 via waveguide 56, coaxial probe 58, and antenna 60 (FIG. 2) as mentioned. Here, griddle 24 and fan 64 are also activated.

In response to activation of fan 64, air from outside of microwave oven 10 is drawn into the oven 10 through inlet port 18, and more particularly through the inlet filter 20 disposed thereover, as shown by arrows in FIGS. 1 and 2. The air flow enters the front portion 50*a* of electronics compartment 50 to cool electronics disposed therein. Such air flow is then drawn through the fan 64 and into the rear portion 50*b* of electronics compartment 50 where it flows through magnetron 54 to cool the magnetron 54 and also through an aperture 66 in separating wall 48 behind magnetron 54, as can be seen in FIG. 2. Once such air flow enters the portion of outer housing 12 in which cooking cavity 14 is disposed, it flows between the outer housing 12 and cooking cavity 14, as shown by the arrows in FIGS. 1-3. More particularly, the air flows between the outer housing top wall 12*a* and the cooking cavity top wall 14*a*, as can be see in FIGS. 1-3. Air flows between outer housing side wall 12*c* and cooking cavity side wall 12*c*, as shown in FIGS. 1 and 2. Further, air flow occurs between cooking cavity side wall 14*e* and separating wall 48, as shown in FIG. 2, and additional air flow occurs between outer housing rear wall 12*d* and cooking cavity rear wall 14*d*, as shown by the arrows in FIG. 3 and by dotted arrows in FIG. 2. Some of the air flow exits outer housing 12 through exhaust ports 16 as shown in FIG. 2. However, a substantial portion of the air entering microwave oven 10 through inlet port 18 flows to an area between the bottom wall 26*b* of wrapper 26 and outer housing bottom wall 12*b*.

More particularly, such air flow enters the plenum 27 defined by wrapper 26 through aperture 28, as can be seen in FIGS. 2 and 3. Having entered plenum 27, the air flows passes along the underside of electric griddle 24 and into cooking cavity 14 through perforations 30 in side walls 14*c* and 14*e* and rear wall 14*d* of cooking cavity 14 as shown in FIG. 2, and as partially shown in FIGS. 1 and 3. Stated differently, a flow of air is directed along the underside of the electric griddle 24 to heat the air and such heated air is then directed through the perforations 30 to provide convective heating within the cooking cavity 14. The air enters cooking cavity 14 through perforations 30 due to natural convection effects with some assistance from fan 64.

As the air flows underneath griddle 24, heat is transferred from the griddle 24 to such air. Here, the air routed through plenum 27 is heated to a temperature between approximately 250° F. and 575° F., and more preferably between approximately between 350° F. and 450° F. Note also that a certain amount of "pre-heating" of the air is achieved by such air flow having passed through magnetron 54 to cool the magnetron 54.

The air flow arrangement described above and shown in FIGS. 1-3 provides several benefits to the combination microwave/griddle/convection oven 10. First, substantially uniform heating of a food product 106 disposed on griddle 24 is achieved. More particularly, uniform heating is provided by placing the food product 106 on griddle 24 which itself is at a substantially uniform temperature as well as by routing air of a substantially uniform temperature over such food product 106 to provide convection heating thereof.

More particularly, the griddle 24 is maintained at a substantially uniform temperature by routing the air flow thereunder in a substantially even or uniform distribution. In other words, by evenly distributing the flow of air under griddle 24, substantially uniform heat transfer occurs between the griddle 24 and such air over substantially the entire area of the griddle 24. Whereas, if such air flow were only routed under a portion of the griddle 24, there may be a temperature differential between the portion of the griddle 24 underneath which such air flows and other portions thereof. Furthermore, this arrangement of routing the air flow under substantially the entire area of griddle 24 provides the air entering cooking cavity 14 through perforations 30 at a substantially uniform temperature. Stated differently, substantially all of the air flowing beneath griddle 24 is heated to the same temperature.

Moreover, the uniformity of cooking is further enhanced by the introduction of the convective air from three walls 14*c*-14*e* of cooking cavity 14.. In other words, the arrangement with which the convective air is introduced into cooking cavity 14 further enhances the cooking uniformity by providing substantially uniform contact between the convective air and the food product 106.

Another advantage of the air flow arrangement described above is the efficiency with which heat is transferred from the griddle 24 to the air flowing thereunder through plenum 27. Highly efficient heat transfer is achieved by the structure of plenum 27 which forces the air to flow in close proximity to the underside or bottom surface of griddle 24. Here, the depth of plenum 27 (i.e. the distance between the bottom surface of griddle 24 and the bottom wall 26*b* of wrapper 26) is approximately 0.7 inches and the aperture 28 is approximately 1.25 inches in diameter. However, it should be appreciated that the heat transfer between the griddle 24 and the air flow passing thereunder can be increased or decreased by increasing or decreasing the diameter of aperture 28 and/or depth of plenum 27, respectively, as desired. In this way, the temperature of the convective air can be adjusted. Further enhancement of the heat transfer efficiency can be realized by adding fins in plenum 27, for example such fins extending down from the bottom surface of griddle 24 into plenum 27. In this way, the surface area available for transferring heat from the griddle 24 to the air is increased. Additionally, such fins would increase the turbulence of the air flow to reduce any laminar effect and thereby enhance the heat transfer. Thus, fins may also be arranged to extend up from bottom wall 26*b* of wrapper 26 into plenum 27 to increase turbulence of the air flow.

Note also that it may be desirable to provide auxiliary heating elements for further heating the convective air. For example, resistive heating elements (not shown) may be provided in the path of such air flow through plenum 27.

A further benefit of the oven arrangement described above is the elimination of insulation heretofore required under a griddle. Here, the air flow below electric griddle 24 eliminates the need for insulation disposed between the griddle 24 and the bottom wall 12*b* of outer housing 12, such insulation being required to maintain bottom wall 12*b* at a suitably safe temperature. Another advantage is that the convection heating is realized without requiring a separate or dedicated fan and/or heating element. In other words, the fan 64 used to assist the convective air flow also provides means for cooling electronics within oven 10 and the heating element 25 also serves to provide a griddle 24.

Referring now specifically to FIG. 3, the description of microwave oven 10 will be continued with reference to the way in which air, having been directed into cooking cavity 14, is vented or exhausted therefrom. First, however, the structure of microwave oven door 32 is described in greater detail. Note that the cross sectional view shown in FIG. 3 is taken along lines 3—3 of FIG. 1 but with microwave oven door 32 in the closed position.

Door 32 is comprised of an outer panel 72, an inner panel 74, and a choke seal 76 disposed around the perimeter of the door 32. More particularly, choke seal 76 is comprised of an end portion 78 of inner panel 74; an end portion 80 of outer panel 72, and a perforated wall 82, arranged to define a choke cavity 84. Stated differently, an input section of choke seal 76 is formed by end portion 78 of inner panel 74 and, along the top of the seal 76, the adjacent portion of cooking cavity top wall 14*a* and, along the bottom of the seal 76, the adjacent portion of cooking cavity bottom wall 14*b*. An output section of choke seal 76 is formed by end portion 80 of outer panel 72 and the adjacent portion of outer housing partial front wall 12*f*. As is known, choke seal 76 is designed to prevent leakage of microwave energy by having a choke cavity 84 with an effective electrical length of one-quarter wavelength at the operating frequency. Here, outer panel 72, inner panel 72, and perforated wall 82 are comprised of stainless steel. As is known, the diameter of the perforations 86, the thickness of the perforated wall 82, and the spacing between perforations 86 are related to microwave energy leakage. Here, the perforations 86 have diameters of approximately 0.62 inches and are staggered on approximately 0.09 inch centers and perforated wall 82 has a thickness of approximately 0.029 inches. Note also that here, the operating frequency of microwave oven 10 is 2,450 Hz.

Outer panel 72 of door 32 has a plurality of exhaust ports or vents 88 disposed therethrough. Here, door handle 34 is attached to a central portion of outer panel 72 so that exhaust ports 88 are disposed on either side thereof. The outer panel 72 is spaced from inner panel 74 to form a hollow region 73 within the door 32. The door 32 has an aperture 90 disposed at the bottom thereof.

As shown in FIG. 3 and as mentioned above, a hinge 44 is coupled to partial front wall 12*f* of outer housing 12 and to door 32, as shown. When door 32 is open, a bottom portion 32*a* thereof rests against hinge 44.

In operation of microwave oven 10, air enters cooking cavity 14 as described above, through perforations 30 in walls 14*c*–14*e* thereof. Such air flow, having passed over the food product 106 disposed on electric griddle 24 exits cooking cavity 14 through door 32. More particularly, the air flows into choke cavity 84 and through perforations 86 of perforated wall 82. An ambient flow of air enters the hollow region 73 of door 32 through aperture 90 and mixes with the air flow from cooking cavity 14 before exiting the hollow region 73 through exhaust ports 88, as shown by arrows in FIG. 3. Thus, air flows from the cooking cavity 14 through the perforations 86 of choke seal 76 to mix with ambient air entering the hollow region 73 through the aperture 90 and to exit the hollow region 73 through the exhaust ports 88.

The above described exhaust scheme is desirable for several reasons. First, by directing the exhaust out of microwave oven 10 through front facing door 32, several such ovens 10 may be mounted in a stacked arrangement for industrial use. In other words, in certain industrial applications, it may be desirable to have a plurality of microwave ovens 10 mounted on top of one another and/or adjacent to one another, for example on a rack. Such an arrangement may be difficult to implement where the microwave oven exhaust is disposed on the top, bottom, rear, or sides of the microwave oven since the rack arrangement is unlikely to provide suitable venting for such an exhaust.

A further benefit of exhausting air through door 32 is that this arrangement, in combination with the introduction of convective air into cooking cavity 14 through three walls 14*c*–14*e* thereof, provides a substantially uniform flow of convective air through cooking cavity 14. An additional benefit of the particular exhaust arrangement through the choke seal 76 of door 32 is that such arrangement provides for the mixing of the hot air exiting cooking cavity 14 with the ambient air drawn through door 32 from aperture 90, as mentioned above. In other words, because the flow of the heated air is regulated by, inter alia, the perforated wall 82 of door 32 and further because of the ambient air flowing through door 32 from aperture 90, a problem otherwise experienced with exhausting through the door 32 is avoided. More particularly, the problem of the outer panel 72 of the door 32 becoming excessively hot is avoided.

As mentioned above, microwave radiation generated by magnetron 54 is provided to cooking cavity 14 by intermediate coupling to a waveguide 56 and a coaxial probe 58, as shown in FIG. 2. An antenna 60 is coupled to a first end of an antenna shaft 120 (FIG. 4–6) and extends into an upper portion 94 of cooking cavity 14, as shown. A grease shield 96 is disposed horizontally in cooking cavity 14 and separates such upper portion 94 of cooking cavity 14 from a lower portion 98 thereof, in which food products 106 are disposed for cooking. A purpose of shield 96 is to shield the antenna 60, coaxial probe 58, and waveguide 56 from food. Preferably grease shield 96 is removable to facilitate cleaning. Grease shield 96 may be comprised of any microwave transparent material such as plastic or glass. Here, "Pyroceram" a trademark of Corning Glass Works of Corning, N.Y. is used due to its ability to withstand the relatively high temperatures to which cooking cavity 14 will be exposed during convection cooking.

Disposed concentrically around antenna 60 is a cylindrical member 100 comprised of an suitable conductive material such as stainless steel. Cylinder 100 may be attached by any suitable means to top wall 14*a* of cooking cavity 14, or to grease shield 96, or both. However, due to the desirability of allowing grease shield 96 to be removable, preferably the cylindrical member 100 is attached to cooking cavity top wall 14*a*.

Disposed adjacent to cylindrical member 100 and in top portion 94 of cooking cavity 14 is an absorber material 104. More particularly, here, a layer 104*a* of microwave absorbing material is disposed adjacent to grease shield 96. Layer 104*a* is here comprised of silicon carbide but alternatively may be comprised of any suitably microwave lossy material such as a carbon loaded or resistive loaded plastic or ceramic, or a magnetic lossy material. In general, any material presently used or suitable as a susceptor, may be suitable for this application. For example, a ferrite loaded silicone may be applied on a conductive surface such as on the portions of cooking cavity walls 14*c*–14*e* disposed in upper portion 94 of cooking cavity 14 or on a portion of cooking cavity top wall 14*a*. While one layer 104*a* of absorbing material 104 is shown here in FIGS. 2 and 3, in certain applications more layers may be desirable, for example such additional layers may be attached to the cooking cavity top wall 14*a* or other walls of the oven 10. Here, layer 104*a* has a thickness of approximately 0.19 inches and is attached to the grease shield 96 by a suitable adhesive such as a silicone adhesive manufactured by Dow Corning of Midland, Mich. It should be noted that a thinner layer of absorbing material 104 may be used. However, the ease with which such material 104 can be applied may limit the minimum thickness since a thinner layer may flake or be brittle. Furthermore, while a thicker layer 104*a* of absorbing material may be desirable since the thickness is related to the amount of microwave energy absorbed, the more microwave energy absorbed by material 104, the lower the efficiency of oven 10. Thus, from the above it is apparent that the particular thickness of absorbing material 104 may preferably be determined by weighing factors of optimum cooking results, ease of adhesion, and oven efficiency.

The combination of the cylindrical member 100 and the absorbing material 104 has been found to improve the uniformity of cooking in oven 10. More particularly, here, oven 10 has a relatively low profile (i.e. a width substantially larger than its height) and is optimized for uniform cooking foods with a relatively low profile, such as pizzas or pies.

While the reasons for this uniformity improvement may not be fully understood, one possible explanation is provided. The absorber material 104 reduces reflections of microwave energy from the walls of the cooking cavity 14. Thus, energy absorbed by the food product 106 more closely relates to or is more directly a function of the radiating energy pattern. With this arrangement, the radiating pattern parameters can be adjusted to obtain the desired heating profile. Further, with less energy being reflected from cavity walls 14*a*–14*e*, there is less energy entering the food product 106 horizontally. Therefore, there is less tendency for the edge portions to overheat with respect to the central portion of the food product 106.

Figure 4:
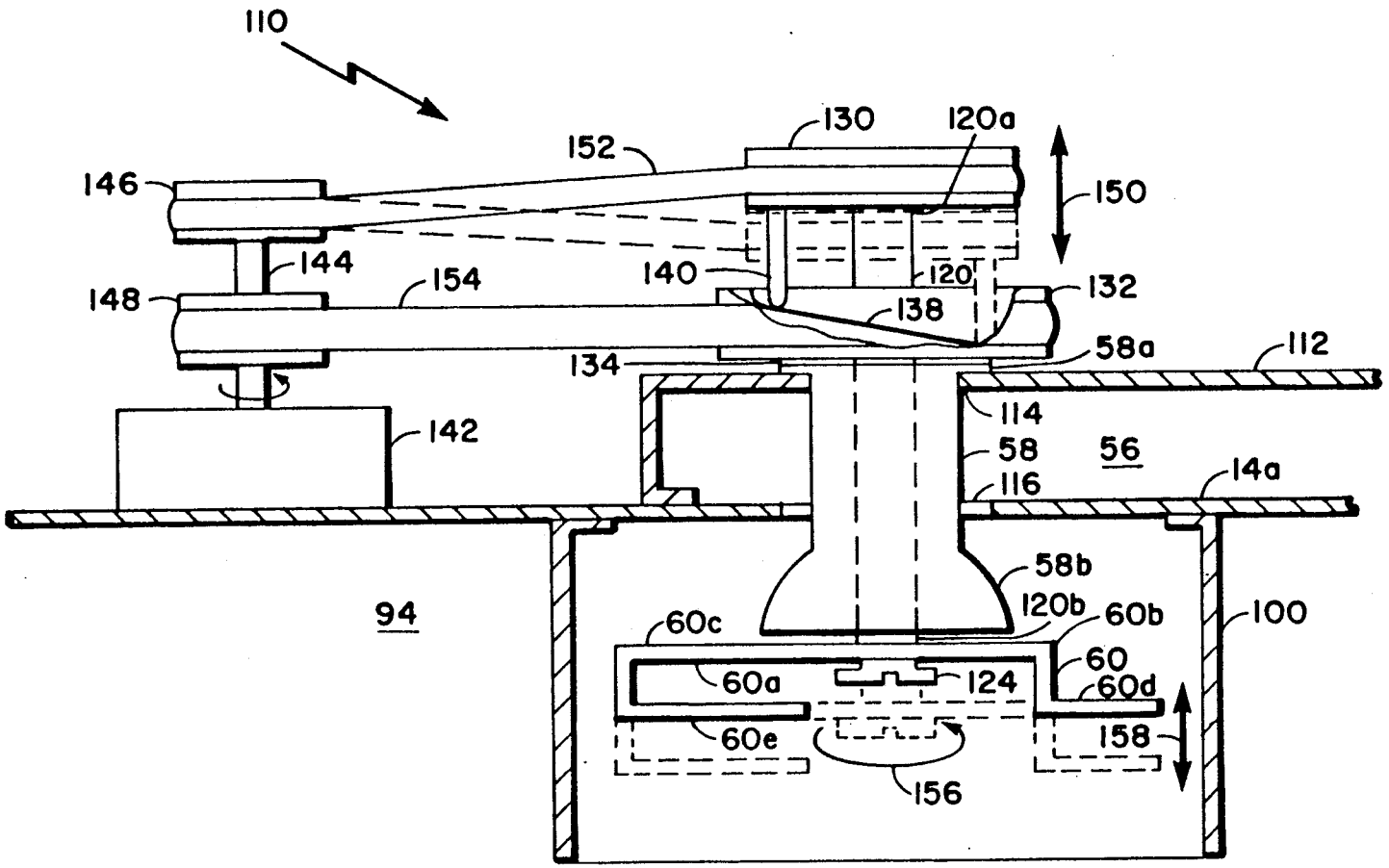
FIG. 4 is a partially sectioned view of a microwave oven antenna arrangement taken along lines 4—4 of FIG. 2.

Referring now to FIG. 4, the microwave oven antenna arrangement 110 (FIG. 2) will now be described. As mentioned above, microwave energy generated by magnetron 54 is coupled to the cooking cavity 14 through a waveguide 56. More particularly, waveguide 56 is defined on a first side by top wall 14*a* of cooking cavity 14 and on a second side by a waveguide wall 112, as shown. Microwave energy coupled through waveguide 56 is further coupled to a coaxial transition member, or coaxial probe 58. More particularly, coaxial probe 58 has a first end 58*a* extending through an aperture 114 in waveguide wall 112. End 58*a* of coaxial probe 58 is securely attached to a top side of waveguide wall 112 by any suitable means. A second end 58*b* of coaxial probe 58 extends into the top portion 94 of cooking cavity 14 through an aperture 116 in the top wall 14*a* of cooking cavity 14. Note that the apertures in waveguide 56 should have a diameter of less than approximately one-half of a wavelength at the operating frequency to prevent leakage of microwave energy. Coaxial probe 58 has a central aperture through which an antenna shaft 120, here comprised of Teflon but alternatively comprised of any microwave transparent material, extends, as shown by the dotted lines. A first end 120*a* of antenna shaft 120 is coupled to a first driven gear 130 and a second end 120*b* is coupled to radiating element, or antenna 60. More particularly, antenna element 60 is secured to antenna shaft 120 by any suitable means and here, by a screw 124 as shown. A preferred antenna 60 has a horizontal central portion 60*a* extending approximately 1.82 inches from the center thereof (i.e. coupled to antenna shaft 120) to a first end 60*b* and approximately 1.75 inches to a second end 60*c*. The first end 60*b* of the central portion 60*a* extends approximately 0.95 inches vertically downward and terminates at an approximately 2.4 inch horizontal finger 60*d* extending away from the second end 60*c*. The second end 60*c* of the central portion 60*a* also extends approximately 0.95 inches vertically downward and terminates at an approximately 2.25 inch horizontal finger 60*e* extending towards the first end 60*b*.

Cylindrical member 100 is disposed concentrically around antenna element 60, as shown. As mentioned above, cylindrical member 100 may be coupled to top wall 14*a* of cooking cavity 14, as shown here, or to grease shield 96 (FIG. 2).

Also coupled to antenna shaft 120 is a second driven gear 132, here disposed between coaxial probe 58 and the first driven gear 130. More particularly, the second driven gear 132 is disposed concentrically around the antenna shaft 120 but is not secured thereto. A thrust washer 134 is disposed between the second driven gear 132 and the first end 58*a* of coaxial probe 58, as shown. The second driven gear 132 has a slanted surface 138 disposed adjacent to the first driven gear 130. A cam follower member 140 is attached to, and extends from first driven gear 130 to contact, or engage with, the slanted surface 138 of the second driven gear 132, as shown.

First and second driven gears 130 and 132 are rotated by a motor 142 here disposed above the top wall 14*a* of cooking cavity 14, as shown. More particularly, motor 142 has a drive shaft 144 extending therefrom which engages with first and second drive gears 146 and 148, respectively. First drive gear 146 is coupled to first driven gear 130 by a first drive belt 152. Similarly, second drive gear 148 is coupled to second driven gear 132 by a second drive belt 154, as shown. Here, first and second drive belts 152 and 154 are shown as O-ring type belts. However, it should be appreciated that other types of conventional drive belts, for example chain ladder drive belts may alternatively be used.

In operation of microwave oven 10, motor 142 is activated causing drive shaft 144 to rotate, as shown by the arrow. Such rotation in turn imparts rotation to first and second drive gears 146 and 148 which cause concomitant rotation of driven gears 130 and 132, respectively. Note however that since only driven gear 130 is fixedly coupled to antenna shaft 120, independent rotation of driven gear 130 and driven gear 132 is achieved. Moreover, as can be seen in FIG. 4, the diameters of first driven gear 130 and second driven gear 132 are different from each other. With this arrangement, relative motion is provided between the first driven gear 130 and the second driven gear 132. In other words after consecutive revolutions of driven gear 130, cam follower member 140 will contact different locations of slanted surface 138. With this arrangement, the antenna element 60 will be disposed at a different rotational angle after consecutive revolutions thereof. Thus, the antenna 60 is rotated and simultaneously cycled through a vertical excursion. It should be appreciated that such motion could alternatively be achieved by providing drive gears 146 and 148 with different diameters.

Due to the contact between the cam follower member 140 and the slanted surface 138, when drive gears 146 and 148 rotate driven gears 130 and 132 respectively, second driven gear 130 additionally moves vertically as shown by the dotted lines and arrow 150. In other words, as first driven gear 130 rotates, cam follower member 140, resting on the slanted surface 138 of the second driven gear 132, provides vertical motion to the first driven gear 130. Moreover, since antenna shaft 120 and antenna element 60 are secured to the first driven gear 130, these parts are concomitantly moved vertically as shown in dotted lines and by arrow 158 as they are rotated as shown by arrow 156.

With the above microwave antenna arrangement 110, in which the antenna 60 is moved in a three-dimensional, essentially helical pattern, the cooking uniformity of the oven 10 is improved. More particularly, such uniformity is improved by increasing the randomness of the mode pattern, or microwave radiation pattern, within the cooking cavity 14. This increased randomness of the microwave radiation tends to reduce the occurrence "cold spots" in microwave cooked foods.

While the microwave radiation pattern in cooking cavity 14 is complex, the following discussion may be helpful to better understand its propagation. Three possible modes, or sources of microwave radiation here are (a) a stripline source propagating from the antenna 60 with the ground plane being the top wall 14*a* of cooking cavity 14, (b) radiation propagated from the aperture 116 in top wall 14*a*, and (c) radiation from the coaxial probe 58 itself. Note that dimensions, such as the diameter of aperture 116 and the length of coaxial probe 58 extending into cooking cavity 14, may be designed to be less than one-half of a wavelength at the operating frequency to have the stripline mode of propagation dominate. Here, the diameter of aperture 116 is approximately 1.5 inches and approximately 0.28 inches of coaxial probe 58 extends down into cooking cavity 14. However propagation from all three of the modes, may enhance the randomness of the pattern. Note also that with regard to the stripline mode of propagation, energy is capacitively coupled from the coaxial probe 58 to the antenna 60. Thus, when the antenna 60 is moved vertically downward, away from the probe 60, some energy may be reflected. In fact, the antenna may operate more as a mode stirring device than a radiating element in this position.

Moreover, because of the sensitivity of the mode pattern to the spacing between the antenna 60 and the top wall 14*a* of the cooking cavity 14, these benefits can be realized with a relatively small vertical excursion of antenna 60 (shown by arrow 158). For example, here the vertical excursion of antenna element 60 may be approximately 0.1 inches.

Figure 5:
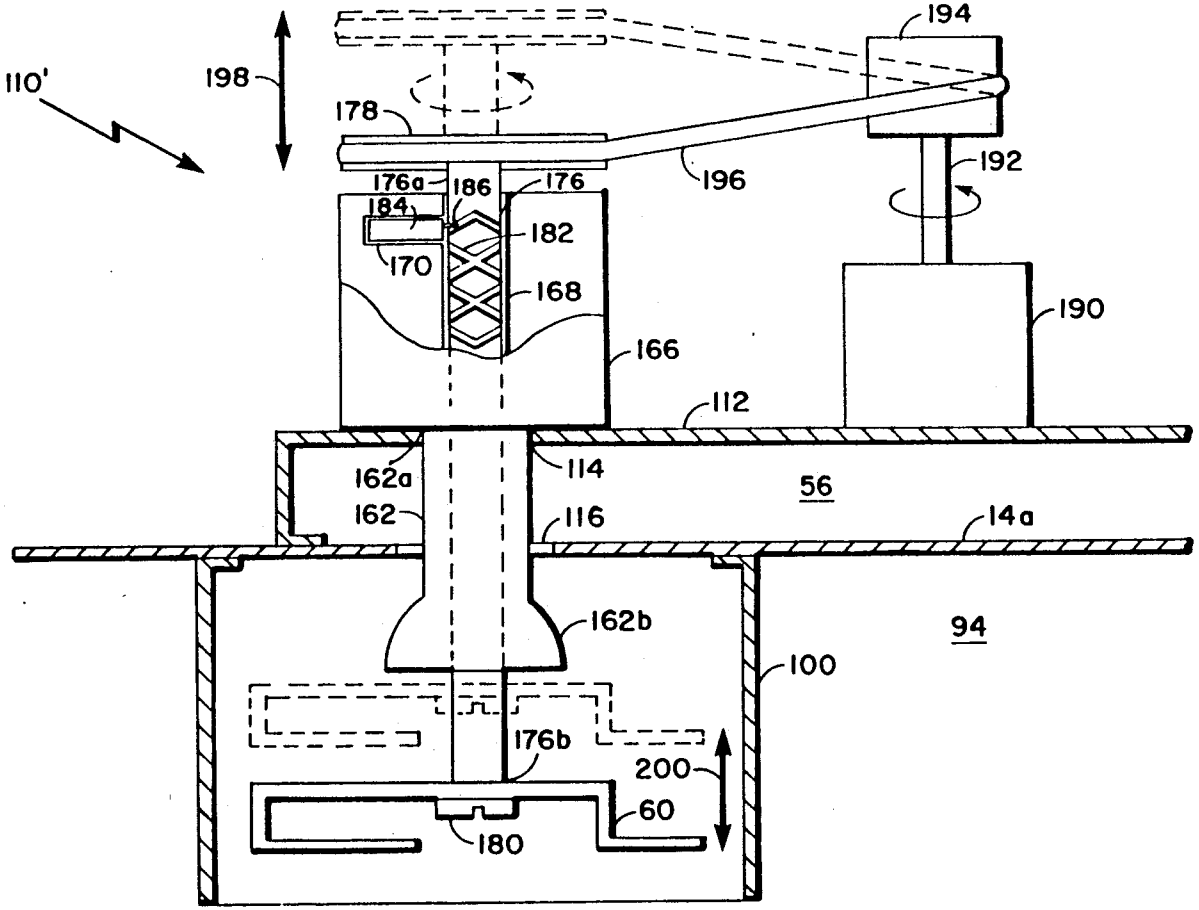
FIG. 5 is a partially sectioned plan view of an alternate embodiment of the microwave oven antenna arrangement of FIG. 4.

Referring now to FIG. 5, an alternate embodiment 110' of antenna arrangement 110 is shown. Here again, microwave energy provided by magnetron 54 (FIG. 2) is coupled to cooking cavity 14 by waveguide 56 defined by the top wall 14*a* of cooking cavity 14 and waveguide wall 112. More particularly, such microwave energy is, here coupled to cooking cavity 14 by a coaxial probe 162 having a first end 162*a* extending through an aperture 114 in waveguide wall 112 and a second end 162*b* extending through an aperture 116 in the cooking cavity top wall 14*a* and into top portion 94 of cooking cavity 14, as shown. As above, the apertures in waveguide 56 should have a diameter of less than one-half of a wavelength at the operating frequency to prevent leakage of microwave energy. Coaxial probe 162 is attached to a sleeve member 166 at the first end 162*a* thereof. The sleeve member 166 and coaxial probe 162 structure is fixedly coupled to waveguide wall 112 by any suitable means. Sleeve member 166 has a longitudinal aperture 168 disposed therethrough as well as a transverse aperture 170 communicating with aperture 168, as shown. Coaxial probe 162 also has a longitudinal aperture extending therethrough and aligned with longitudinal aperture 168. An antenna shaft 176 (like shaft 120 of FIG. 4) extends through the longitudinal aperture 168 of sleeve member 166 and through the longitudinal aperture in coaxial probe 162, as shown. More particularly, a first end 176*a* of antenna shaft 176 is fixedly coupled to a driven gear 178 and a second end 176*b* of antenna shaft 176 has an antenna element 60 coupled thereto. Here, antenna element 60 is coupled to antenna shaft 176 with a screw 180, as shown. Antenna shaft 176 has a helical shaped groove 182 disposed at a top portion thereof. A guide member, or pawl 184 is disposed in the transverse aperture 170 of sleeve member 166 and has a tip 186 extending into the helical groove 182, as shown.

A motor 190 is here shown to be disposed on waveguide wall 112. However, such motor 190 may alternatively be mounted to the top wall 12*a* of outer housing 12 or the top wall 14*a* of cooking cavity 14. A drive shaft 192 is coupled to, and rotated by, motor 190 as shown by the arrow. Coupled to drive shaft 192 is a drive gear 194. A drive belt 196 couples the drive gear 194 to driven gear 178 to provide concomitant rotation thereto, as shown by the dotted arrow around antenna shaft 176.

In operation, as driven pulley 178, antenna shaft 176, and antenna 60 are rotated, vertical motion is imparted thereto due to helical groove 182. In other words, as driven gear 178 is rotated, the tip 186 of pawl 184 extending into the helical groove 182 causes the shaft 176, driven gear 178, and antenna 60 assembly to move vertically, as shown for driven gear 178 in dotted lines and by arrow 198, and for antenna element 60 by arrow 200. More particularly, such shaft 176, driven gear 178, and antenna 60 assembly moves in a helical pattern like that of helical groove 182. It should be noted that pawl 184 is free to rotate somewhat within transverse aperture 170 in order to "follow" the helical groove 182.

Here, the antenna arrangement 110' is designed to provide a fractional ratio of revolutions to vertical excursions of antenna 60. In other words, and as described above in conjunction with antenna arrangement 110 (FIG. 4), antenna 60 will be provided in a different rotation, or angular position after consecutive revolutions thereof. Such an arrangement provides improved randomness to the mode pattern and thus improved cooking uniformity.

Figure 6:
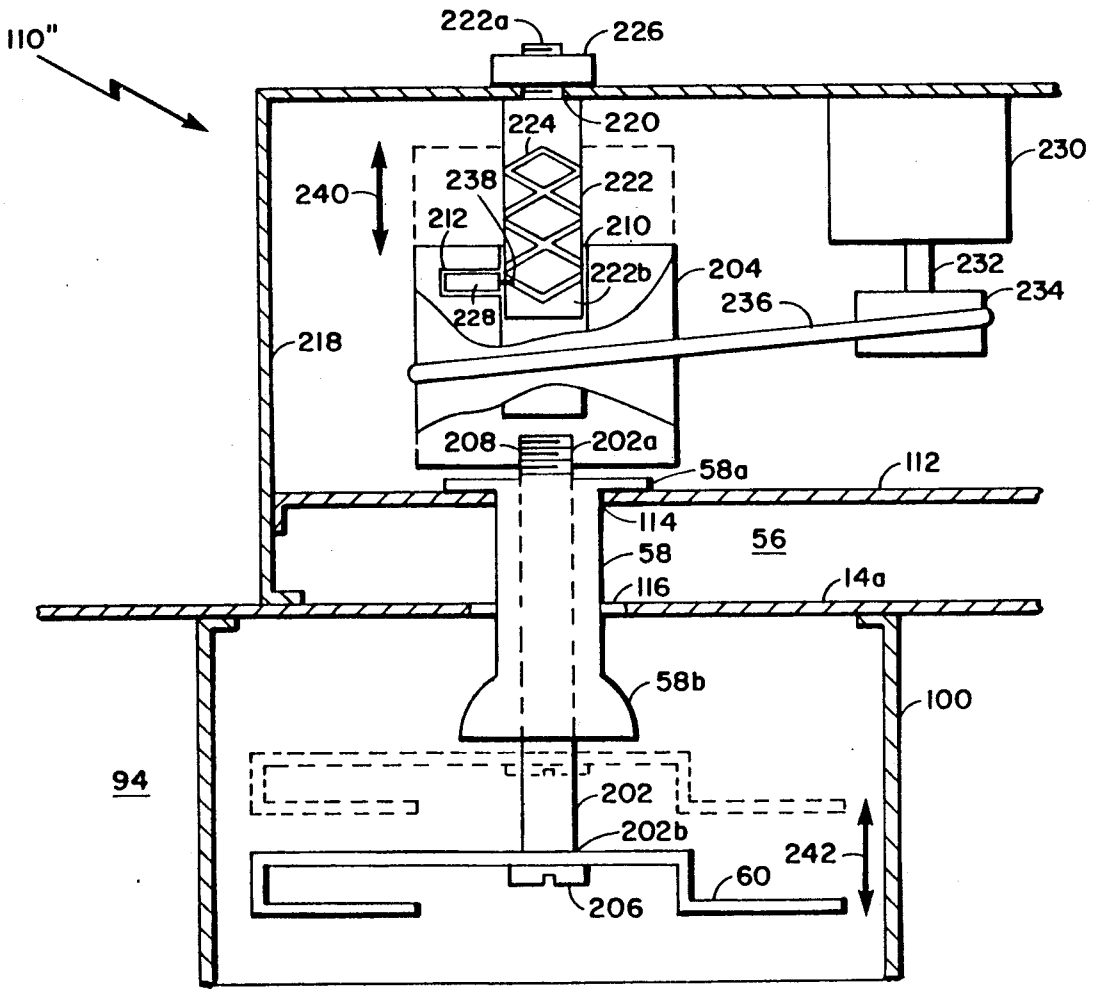
FIG. 6 is a partially sectioned plan view of another alternate embodiment of the microwave oven antenna arrangement of FIG. 4.

Referring now to FIG. 6, a still further embodiment 110'' of antenna arrangement 110 is shown. Again, microwave radiation is coupled to cooking cavity 14 through waveguide 56 defined by the top wall 14*a* of the cooking cavity 14 and waveguide wall 112. More particularly, here microwave energy is coupled to cooking cavity 14 by a coaxial probe 58, identical to that of FIG. 4. In other words, a first end 58*a* of coaxial probe 58 extends through an aperture 114 in waveguide wall 112, whereas a second end 58*b* of coaxial probe 58 extends through an aperture 116 in top wall 14*a*, as shown. Here again, the first end 58*a* of coaxial probe 58 is fixedly attached to waveguide wall 112 by any suitable means. An antenna shaft 202 extends through a longitudinal aperture in coaxial probe 58 and has a first end 202*a* attached to a sleeve member 204 and a second end 202*b* attached to antenna element 60. More particularly, here the second end 202*b* of antenna shaft 202 is coupled to antenna 60 by means of a screw 206, as shown. Here, the first end 202*a* of the antenna shaft 202 has screw threads and is coupled to a threaded recess 208 of sleeve member 204. Sleeve member 204 further has a longitudinal aperture 210 extending substantially therethrough and a transverse aperture 112 communicating with longitudinal aperture 210, as shown.

In the antenna arrangement 110'', a supporting wall 218 extends from the top wall 14*a* of cooking cavity 14 as shown and has an aperture 220 disposed therethrough and aligned with aperture 114 in waveguide wall 112 and aperture 116 in cooking cavity top wall 14*a*. An axle 222 having a helical groove 224 is attached to supporting wall 218. More particularly, a first end 222*a* of axle 222 has screw threads and extends through aperture 220 to engage with a nut and washer combination 226, as shown. It should be noted that any suitable means for attaching axle 222 to supporting wall 218 may alternatively be used. A second end 222*b* of axle 222 extends into the longitudinal aperture 210 of sleeve member 204, as shown. More particularly, a guide member or pawl 228 is disposed in transverse aperture 212 and a tip 238 thereof engages with (i.e. extends into) the helical groove 224, as shown.

A motor 230 is here shown mounted to supporting wall 218. It should be appreciated that such motor 230 may alternatively be coupled to waveguide wall 112 or cooking cavity top wall 14*a*. A drive shaft 232 is attached to, and rotated by, motor 230. Moreover, a drive gear 234 is concomitantly rotated by drive shaft 232. A drive belt 236 couples the drive gear 234 and the sleeve member 204, as shown. Here, drive belt 236 is shown to be an O-ring type belt. However, other suitable belts may alternatively be used.

In operation of microwave oven 10, motor 230 is activated, thereby rotating sleeve member 204, as described above. More particularly, the assembly comprising sleeve member 204, antenna shaft 202, and antenna 60 will thus be rotated. As sleeve member 204 is rotated, pawl 228 and, more particularly tip 238 thereof, causes such sleeve member 204 to move vertically in accordance with the helical groove 224. It should be noted that pawl 228 is free to rotate somewhat within transverse aperture 212 so that tip 238 can "follow" the helical groove 224. In this way, as sleeve member 204 is rotated, such sleeve member 204 moves vertically as shown by arrow 240, thereby causing concomitant vertical motion to antenna 60, as shown in dotted lines and by arrow 242.

As above with antenna embodiments 110 (FIG. 4) and 110' (FIG. 5), here again the antenna arrangement 110'' is designed to provide a fractional ratio of revolutions to vertical excursions of the antenna 60. As mentioned above, this arrangement provides antenna 60 in a different rotational position after successive vertical excursions, thereby increasing mode pattern randomness and cooking uniformity.

Figure 7A:
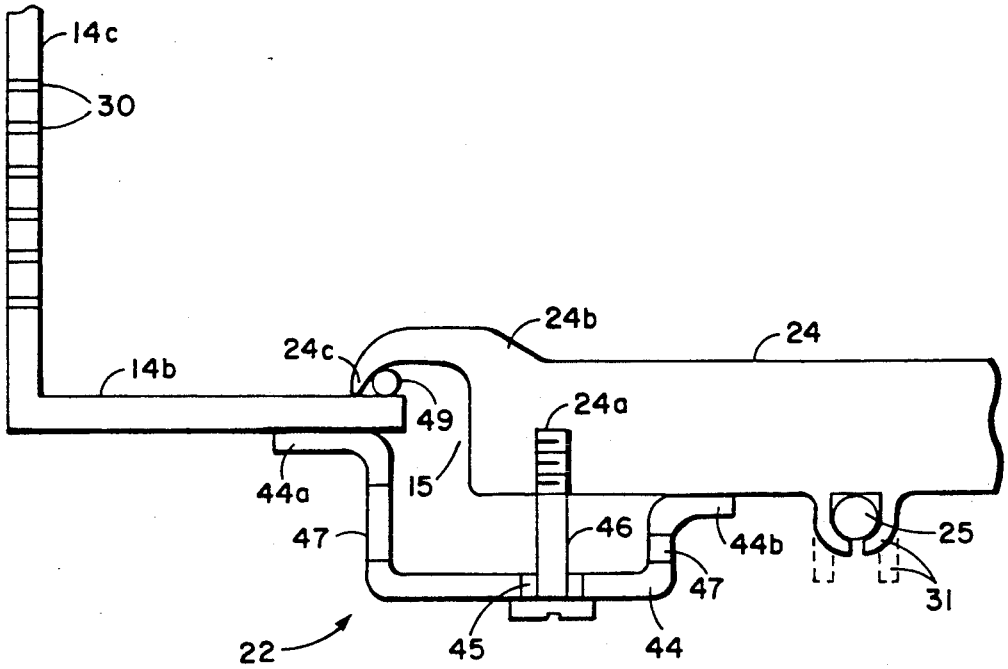
FIGS. 7A–C are expanded views of alternate griddle seals.

Referring now to FIG. 7A, griddle seal arrangement 22 couples the griddle 24 to the cooking cavity floor 14*b*. Here, griddle 24 is disposed in an aperture 15 in floor 14*b*. The griddle seal 22 may be referred to as a clamp 22 and includes a bracket 44, here U-shaped with an aperture 45, and a fastener 46. It should be noted that the bracket 44 may be a continuous member disposed around a peripheral portion of the floor 14*b* adjacent to the aperture 15 therein. In other words, such a continuous member has a plurality of such apertures 45 aligned with a corresponding plurality of tapped apertures 24*a* in griddle 24. Alternatively however, bracket 44 may be comprised of a plurality of individual bracket members 44 disposed intermittently around such peripheral portion of the griddle 24 and the cooking cavity floor 14*b*.

The griddle 24 shown in FIG. 7A is machined from aluminum stock and includes arm portions or compression grooves 31. More particularly, arm portions or compression grooves 31 extend from the bottom surface or underside of griddle 24, as shown by dotted lines. Once the griddle 24 is machined, Calrod heating element 25, of a shape corresponding to the arm portions 31, is placed over the bottom surface thereof and a tool (not shown) is forced against arm portions 31 to deform them to the shape shown by solid lines. Such deformation of arm portions 31 provides intimate contact between griddle 24 and Calrod heating element 25. With this arrangement, the heat provided by Calrod element 25 is effectively transferred to the aluminum griddle 24.

The bottom surface of griddle 24 has a tapped aperture 24*a* disposed therein. In assembly, a first end 44*a* of U-shaped bracket 44 contacts the bottom surface of cooking cavity floor 14*b*, as shown. A second end 44*b* of the bracket 44 contacts the bottom surface of the griddle 24, as shown. A plurality of vent holes 47 may be disposed through the bracket 44, as shown, in order to minimize any effect of the griddle seal 22 on the flow of the convective air (FIG. 2).

Griddle 24 has a lip 24*b*, here raised to help prevent food spillage from griddle 24 onto cooking cavity floor 14*b*. As shown, lip 24*b* terminates at a tapered edge 24*c*. Disposed between the lip 24*b* and the peripheral portion of the cooking cavity floor 14*b* is a gasket 49, here comprised of silicone. It should be noted that gasket 49 may alternatively be comprised of other materials that are deformable and can withstand the relatively high temperatures of the cooking cavity 14, and may also be provided in various shapes.

In assembly, bracket 44 is held in place while the fastener 46 is disposed through aperture 45 and screwed into tapped aperture 24*a* of griddle 24. Thus, a first end of the fastener 46 is coupled to the griddle 24 and a second end is secured by the aperture 45 in bracket 44. As the fastener 46, here a screw, is tightened, the griddle 24 is drawn downwardly to engage the lip 246 down on the peripheral portion of the floor 14*b*. Thus, the tapered edge 24*c* of the griddle 24 and the floor 14*b* of cooking cavity 14 are pulled together. In this way, a substantially continuous metal-to-metal contact is made between the tapered edge 24*c* and the cooking cavity floor 14*b*. This metal-to-metal contact provides a barrier to microwave energy from cooking cavity 14. In other words, the metal-to-metal junction of tapered edge 24*c* and cooking cavity floor 14*b* prevents leakage of microwave energy. Moreover, such a microwave seal is enhanced by the slight deformation of the tapered edge 24*c* when forced downwardly against cooking cavity floor 14*b*. In other words, due to the relative softness of aluminum as compared to stainless steel, as fastener 46 is tightened, the tapered edge 24*c* of aluminum griddle 24 will become somewhat deformed to conform with the contours of the stainless steel cooking cavity floor 14*b*.

Also as screw 46 is tightened, the silicone gasket 49 will be somewhat deformed. This arrangement provides a suitable liquid seal. Thus, water and other liquids are prevented from passing into the bracket 44 by gasket 49.

The tapered edge 24*c* of griddle 24 is further desirable since the fairly small surface area thereof contacting cooking cavity floor 14*b* minimizes the conductive heat transfer between the griddle 24 and such cooking cavity floor 14*b*. That is, because the heat transferred from the relatively hot griddle 24 to the cooking cavity floor 14*b*, and thus to the entire cooking cavity 14 is minimized, the need for insulation around cooking cavity 14 and/or additional cooling fans or blowers is eliminated.

In operation of oven 10, when griddle 24 is activated, and more particularly when the Calrod heating element 25 is activated, aluminum griddle 24 may expand slightly. Moreover, such griddle 24 will expand more than the surrounding cooking cavity floor 14*b* due to the thermal coefficient of expansion of aluminum being greater than that of stainless steel, and further due to the fact that the griddle 24 is heated by the Calrod heating element 25. The griddle seal arrangement 22 allows for movement of griddle 24 relative to cooking cavity floor 14*b*. More particularly, such movement is permitted by the spacing between griddle 24 and adjacent cooking cavity floor 14*b* as well as by the tolerance allowance between the fastener 46 and tapped aperture 24*a* in griddle 24 and between the fastener 46 and the aperture 45 in bracket 44.

Figure 7B:
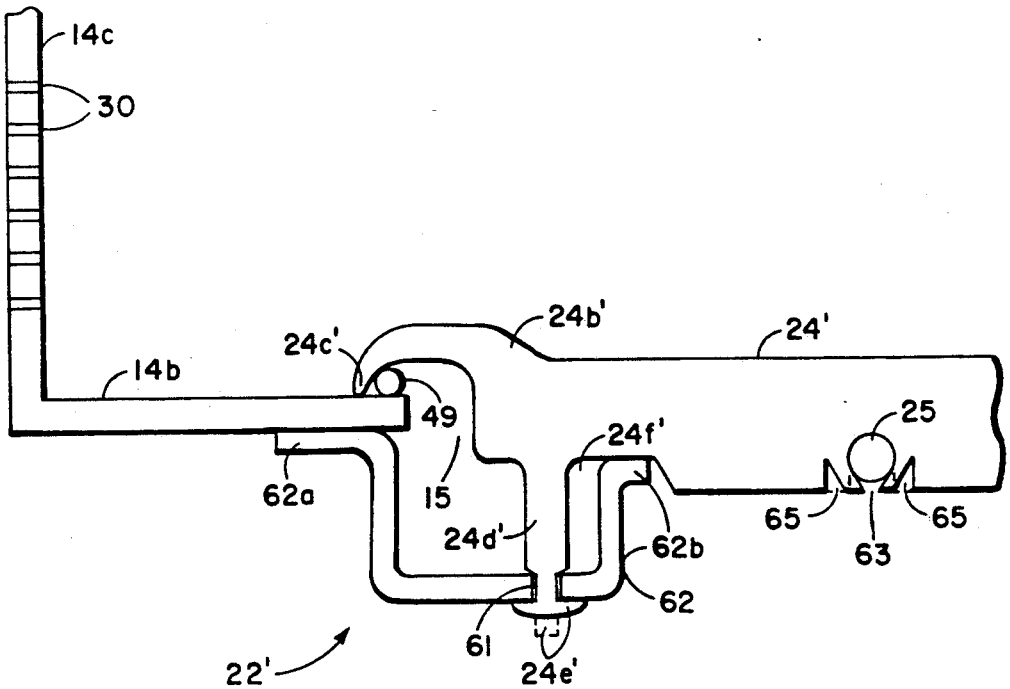

Referring now to FIG. 7B, an alternate embodiment 22' of griddle seal arrangement or clamp 22 is shown. Also shown is an alternate griddle embodiment 24' having a lip 24*b'* with a tapered edge 24*c'*, and a post portion 24*d'* extending from the underside thereof, as shown. Griddle 24' utilizes an alternate method of coupling the Calrod heating element 25 thereto. More particularly, a suitable piece of aluminum stock is machined to provide the griddle 24' with a plurality of grooves 63 (shown by dotted lines) on the bottom surface thereof, in a shape corresponding to that of the desired Calrod heating element 25. The heating element 25 is then disposed in such grooves 63 and a tool (not shown) cuts into the bottom surface of the griddle 24' adjacent to the grooves 63 causing some separation, as shown by the voids 65, and deformation of the material from such voids 65 to surround the Calrod heating element 25, as shown by the solid lines. In this way, intimate contact is made between Calrod heating element 25 and aluminum griddle 24' to facilitate heat transfer therebetween.

The post 24*d'* has an end 24*e'* which extends through an aperture 61 in a bracket 62. More particularly, bracket 62 has a first end 62*a* contacting the bottom surface of cooking cavity floor 14*b* and a second end 62*b* contacting the bottom surface of griddle 24'. Here, the second end 62*b* is disposed in a recessed portion 24*f'* of the bottom surface of griddle 24'. As noted above in conjunction with bracket 44 (FIG. 7A), bracket 62 may be either a continuous member disposed around a peripheral portion of the floor 14*b* adjacent to the aperture 15 therein or may alternatively be comprised of a plurality of individual bracket members 62 disposed intermittently around such peripheral portion.

In assembly, end 24*e'* of post 24*d'* is disposed through the aperture 61 (as shown by the dotted line) and a tool (not shown) applies force on such end 24*e'* to deform it to the shape shown by the solid line. As the end 24*e'* is thus deformed, the griddle 24' is drawn downwardly to engage the lip 24*b'* down on the peripheral portion of the floor, as described above in conjunction with FIG. 7A when fastener 46 is tightened.

In other words, with the end 24*e'* deformed, the griddle seal arrangement 22' provides the benefits described above in conjunction with griddle seal arrangement 22 (FIG. 7A). More particularly, the tapered edge 24*c'* of griddle 24' becomes slightly deformed to conform with the contours of the cooking cavity floor 14*b*. In this way, a metal-to-metal contact is formed between tapered edge 24*c'* and cooking cavity floor 14*b* to provide an effective seal preventing leakage of microwave energy. Moreover, with this arrangement, gasket 49 is somewhat deformed to provide an effective seal to liquids thereby preventing any liquid from passing into the bracket 62. Also, given the tapered edge 24*c'* of griddle 24', the conductive heat transfer between the heated griddle 24' and the surrounding cooking cavity floor 14*b* will be minimized as described above in conjunction with FIG. 7A. Further, the present arrangement permits the aluminum griddle 24' to move relative to cooking cavity floor 14*b* due to the spacing therebetween and the tolerance allowance of the aperture 61 relative to the post 24*d'*.

It should be noted that in the griddle seal arrangement of 22', the second end 62*b* of the bracket 62 will remain substantially stationary due to its placement in recessed portion 24*f'* of griddle 24', as shown. Thus, when griddle 24' moves relative to cooking cavity floor 14*b*, the concomitant movement of bracket 62 will substantially occur at the first end 62*a* thereof.

Figure 7C:
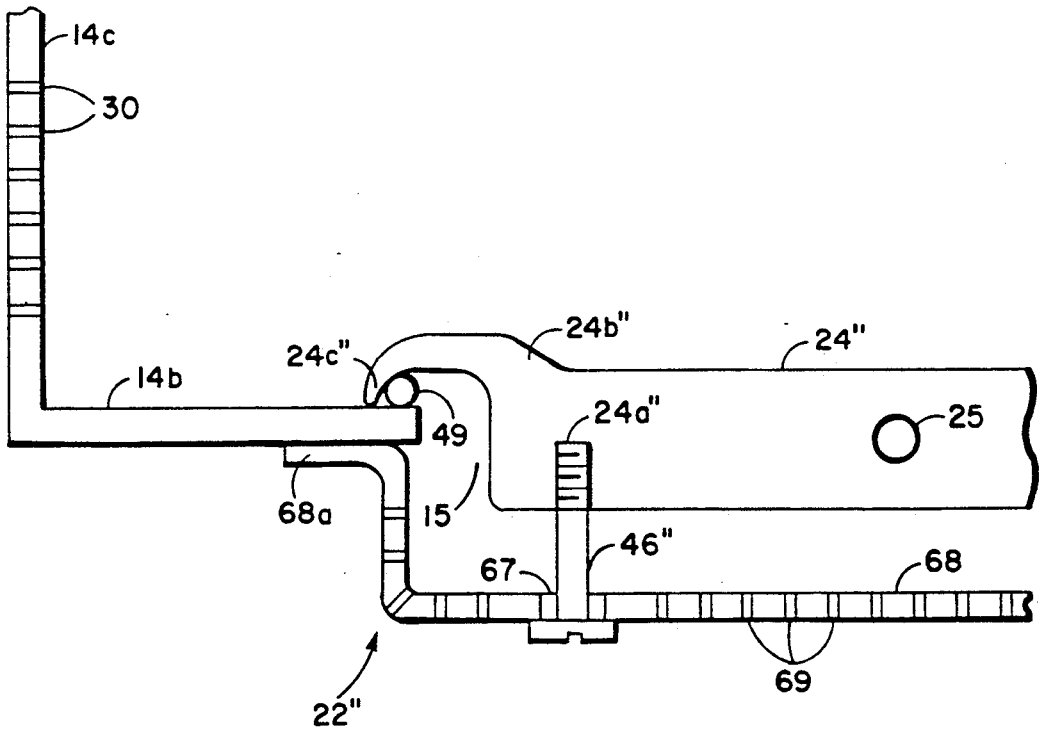

Referring now finally to FIG. 7C, an alternate embodiment 22'' of griddle seal or clamp 22 is shown to include a griddle 24''. Here again, such griddle 24'' includes a lip 24*b''*, a tapered edge 24*c''*, and a tapped aperture 24*a''* in the bottom surface thereof (i.e. like tapped aperture 24*a* of FIG. 7A). Here however, the Calrod heating element 25 is embedded in a central portion of griddle 24'' when the aluminum is formed. This arrangement provides improved contact between the Calrod heating element 25 and the surrounding griddle 24''. Here, a bracket 68 extends substantially under the entire griddle 24''. More particularly, an edge 68*a* of bracket 68 contacts the bottom surface of cooking cavity floor 14*b* at a peripheral portion thereof adjacent to the aperture 15. In this way, a pan-like arrangement is formed by bracket 68. Such bracket 68 has an aperture 67 disposed therethrough and aligned with tapped aperture 24*a*″ of griddle 24″. It should be noted that several of such apertures 67 and 24*a*″ are disposed peripherally around the edge of the griddle 24″ and around the bracket 68, respectively. A fastener 46″, here a screw, extends through apertures 67 and 24*a*″, as shown.

Thus, in assembly, when fastener 46″ is tightened, the griddle 24″ is drawn downwardly to engage the lip 24*b*″ down on the peripheral portion of the floor 14*b* adjacent the aperture 15. This arrangement again provides the benefits described above in conjunction with griddle seal arrangements 22 (FIG. 7A) and 22′ (FIG. 7B). More particularly, in assembly, the tapered edge 24*c*″ minimizes the conductive heat transfer between griddle 24″ and the surrounding cooking cavity floor 14*b*. Moreover, a metal-to-metal contact is achieved between such tapered edge 24*c*″ and cooking cavity floor 14*b* to prevent the leakage of microwave energy. A suitable liquid seal is achieved by the deformation of a gasket 49 disposed between the lip 24*b*″ and the peripheral portion of the floor 14*b*, as shown. And finally, relative movement of griddle 24″ with respect to cooking cavity floor 14*b* is permitted by the spacing therebetween as well as by the tolerance allowances in tapped aperture 24*a*″ and aperture 67 through which the fastener 46″ is disposed.

It should also be noted that the pan-like bracket 68 has a plurality of perforations 69, as shown. This arrangement is desirable in order to minimize any interference with the flow of the convective air (FIGS. 1–3). In other words, by having perforations 69 in bracket 68, such air flow is not hindered in its path underneath griddle 24″ and up into cooking cavity 14 through perforations 30, as described above.

In certain applications, it may be desirable to modify the oven 10 to provide only microwave and griddle cooking. In such a microwave/griddle oven, bracket 68 may be comprised of solid metal and used to support insulation. In this way, the heated griddle 24 would be suitably insulated and prevented from excessively heating the outer housing 12 of microwave oven 10.

Having described preferred embodiments of the invention, it should now become evident to one of skill in the art that other embodiments incorporating its concepts may be used. It is felt, therefore, that this invention should not be restricted to the disclosed embodiments, but rather should be limited only by the spirit and scope of the appended claims.

What is claimed is:

1. A microwave oven comprising:

a cooking cavity;

an antenna positioned within said cooking cavity;

means, including a waveguide, for exciting said antenna with microwave energy; and means for rotating said antenna and simultaneously cycling said antenna through a vertical excursion.

2. The microwave oven recited in claim 1 wherein said rotating and cycling means comprising means for providing said antenna in a different rotational position after consecutive vertical cycles.

3. A microwave oven comprising:

a cooking cavity comprising a bottom wall, a top wall, and side walls, wherein said top wall has an aperture;

a source of microwave energy;

a waveguide having a first end coupled to said microwave energy source and a second end coupled to said aperture;

a hollow coaxial probe extending through said aperture;

a shaft extending through said hollow coaxial probe and having a first end disposed above said waveguide and a second end extending into said cooking cavity;

an antenna coupled to said second end of said shaft; and means coupled to said first end of said shaft for providing rotational and vertical motion to said antenna.

4. The microwave oven recited in claim 3 wherein said motion providing means comprises:

a motor;

a pair of drive gears coupled to and rotated by said motor;

a corresponding pair of driven gears, wherein a first one of said pair of driven gears has a fixed horizontal position and a slanted surface and a second one of said pair of driven gears has a cam follower member extending therefrom to contact said slanted surface; and a pair of belts, each one of said pair of belts being coupled between one of the pair of drive gears and a corresponding one of the pair of driven gears.

5. The microwave oven recited in claim 4 wherein the first and second drive gears have different diameters.

6. A microwave oven recited in claim 4 wherein the first and second driven gears have different diameters.

7. The microwave oven recited in claim 3 wherein said shaft has a helical groove and said motion providing means comprises:

a sleeve member disposed in a fixed position above said waveguide and having a longitudinal aperture through which said antenna shaft extends and a transverse aperture with a pawl disposed therein, wherein a tip of said pawl extends into said helical groove;

a motor;

a drive gear coupled to and rotated by said motor;

a driven gear coupled to said first end of said shaft; and a belt coupled between said drive gear and said driven gear.

8. The microwave oven recited in claim 7 wherein the ratio of revolutions to vertical excursions is a fractional number to provide said antenna in a different rotational position after consecutive vertical excursions.

9. The microwave oven recited in claim 3 wherein said motion providing means comprises:

an axle coupled to and extending vertically above said top wall of said cooking cavity, said axle having a helical groove;

a sleeve member having a first end with a longitudinal recess and a second end coupled to said shaft, said sleeve member further having a transverse aperture communicating with said longitudinal recess and a pawl disposed in said transverse aperture, wherein said axle extends into said longitudinal recess and a tip of said pawl extends into said helical groove;

a motor;

a drive gear coupled to and rotated by said motor; and a belt coupled between said drive gear and said sleeve member.

10. The microwave oven recited in claim 9 wherein the ratio of revolutions to vertical excursions is a fractional number to provide said antenna in a different rotational position after consecutive vertical excursions.

* * * * *